US011373620B2

(12) United States Patent
Gao et al.

(10) Patent No.: US 11,373,620 B2
(45) Date of Patent: Jun. 28, 2022

(54) CALIBRATION DEVICE AND CALIBRATION METHOD FOR DISPLAY PANEL BRIGHTNESS UNIFORMITY

(71) Applicant: REALTEK SEMICONDUCTOR CORPORATION, Hsinchu (TW)

(72) Inventors: Zhen-Xin Gao, Suzhou (CN); Hong-Yang Ge, Suzhou (CN)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/078,141

(22) Filed: Oct. 23, 2020

(65) Prior Publication Data

US 2021/0125579 A1 Apr. 29, 2021

(30) Foreign Application Priority Data

Oct. 28, 2019 (CN) ..... 201911030167.1

(51) Int. Cl.
*G09G 5/10* (2006.01)

(52) U.S. Cl.
CPC ..... *G09G 5/10* (2013.01); *G09G 2320/0233* (2013.01); *G09G 2320/0693* (2013.01); *G09G 2360/16* (2013.01)

(58) Field of Classification Search
CPC ..... G09G 5/10; G09G 2320/0233; G09G 2320/0693; G09G 2360/16
See application file for complete search history.

(56) References Cited

U.S. PATENT DOCUMENTS 7,330,190 B2 * 2/2008 Sasaki ..... G09G 3/3611 345/590
9,800,793 B2 * 10/2017 Chang ..... G06V 10/60
10,777,168 B2 * 9/2020 Han ..... G06V 40/1324
10,825,375 B1 * 11/2020 Lin ..... G09G 3/3208
(Continued)

*Primary Examiner* — Amare Mengistu
*Assistant Examiner* — Jennifer L Zubajlo
(74) *Attorney, Agent, or Firm* — WPAT, PC

(57) ABSTRACT

Disclosed is a calibration device and calibration method for display panel brightness-uniformity. The method includes: storing a first-mode measured brightness-value, K sets of maximum brightness-values of a display region, a set of second-mode brightness-reference-values, and a second ratio of a second-mode measured brightness-value to the first-mode measured brightness-value; calculating a second-mode brightness-value according to the first-mode measured brightness-value and the second ratio; calculating a second-mode target brightness ratio according to a target brightness setting and the second-mode brightness-value; calculating X second-mode target brightness-value(s) according to the set of second-mode brightness-reference-values and the second-mode target brightness ratio; calculating K sets of second-mode colored-component brightness-values according to the K sets of maximum brightness-values; generating X second-mode brightness curve(s) according to the K sets of second-mode colored-component brightness-values; and calculating X second-mode brightness-gain(s) for second-mode calibration according to the X second-mode target brightness-value(s) and the X second-mode brightness curve(s).

16 Claims, 5 Drawing Sheets

(56) References Cited

U.S. PATENT DOCUMENTS

| | | | | |
|---|---|---|---|---|
| 2004/0196250 | A1* | 10/2004 | Mehrotra | H04N 9/73 348/E17.005 |
| 2007/0052735 | A1* | 3/2007 | Chou | G09G 3/2003 348/E17.005 |
| 2007/0146266 | A1* | 6/2007 | Yasuda | G09G 3/3406 345/88 |
| 2009/0207182 | A1* | 8/2009 | Takada | G09G 3/3607 345/589 |
| 2012/0147161 | A1* | 6/2012 | Kim | H04N 13/356 348/58 |
| 2012/0293400 | A1* | 11/2012 | Matsubayashi | G09G 3/3406 345/88 |
| 2014/0307007 | A1* | 10/2014 | Cho | G09G 3/3406 345/102 |
| 2015/0310798 | A1* | 10/2015 | Heide | G09G 3/36 345/55 |
| 2015/0317928 | A1* | 11/2015 | Safaee-Rad | G09G 3/006 345/593 |
| 2016/0189590 | A1* | 6/2016 | Jin | G09G 5/02 345/590 |
| 2016/0260368 | A1* | 9/2016 | Zheng | G09G 3/36 |
| 2017/0103694 | A1* | 4/2017 | Kim | G09G 3/006 |
| 2017/0316754 | A1* | 11/2017 | Katougi | G09G 3/007 |
| 2018/0225075 | A1* | 8/2018 | Park | G09G 3/3233 |
| 2019/0172186 | A1* | 6/2019 | Liu | G06T 5/40 |
| 2019/0251929 | A1* | 8/2019 | Fossati | H04N 9/643 |
| 2020/0098333 | A1* | 3/2020 | Marcu | G06T 7/90 |
| 2020/0126498 | A1* | 4/2020 | Li | G09G 3/3607 |
| 2020/0210366 | A1* | 7/2020 | Das Sharma | G06F 13/4282 |
| 2020/0365113 | A1* | 11/2020 | Chen | G09G 5/02 |

* cited by examiner

200

CALIBRATION DEVICE AND CALIBRATION METHOD FOR DISPLAY PANEL BRIGHTNESS UNIFORMITY

BACKGROUND OF THE INVENTION

1. Field of the Invention

The present disclosure relates to a calibration device and calibration method, especially to a calibration device and calibration method for display panel brightness uniformity.

2. Description of Related Art

When calibrating the brightness uniformity of a display panel in each kind of display modes, a conventional art will take photos of the screen of the display panel under different kinds of display setting including red-screen setting, green-screen setting, blue-screen setting, and different kinds of brightness setting for each kind of the display modes so that a calibrating system can used these photos to calibrate different display regions of the display panel for brightness uniformity. If there are a lot of kinds of display modes and a lot of kinds of brightness setting, it will take a lot of time to take photos and the overall time for the calibration will be very long, which is disadvantageous to the production cost.

For example, the conventional art will take nine photos including a red picture, a green picture, a blue picture, and six gray-level pictures including a white picture in each kind of display modes for measurement and analysis. If there are six kinds of display modes, the conventional art has to take 6×9=54 pictures. Provided it takes three seconds for taking and processing one picture, it will take 3×54=162 seconds for taking and processing 54 pictures, and this is not efficient in productivity.

SUMMARY OF THE INVENTION

An object of the present disclosure is to provide a calibration device and calibration method for display panel brightness uniformity. Compared with the prior art, the calibration device and calibration method are more efficient in productivity.

An embodiment of the calibration device of the present disclosure can generate second mode calibration data of a second mode according to known first mode calibration data of a first mode. This embodiment includes a storage circuit, a mode brightness calculating circuit, a target brightness ratio calculating circuit, a target brightness calculating circuit, an interpolating circuit, and a gain calculating circuit. The storage circuit is configured to store the first mode calibration data and reference data, in which the first mode calibration data include a first mode measured brightness value and K sets of maximum brightness values of a display region, the display region is one of multiple display regions of a display panel, the K sets of maximum brightness values are based on K sets of red, green, and blue (RGB) input values, each set of the K sets of maximum brightness values includes a red-component maximum brightness value, a green-component maximum brightness value, and a blue-component maximum brightness value, the reference data include a second ratio of a second mode measured brightness value to the first mode measured brightness value and a set of second mode reference brightness values, and the set of second mode reference brightness values includes a second mode red-component reference brightness value, a second mode green-component reference brightness value, and a second mode blue-component reference brightness value. The mode brightness calculating circuit is configured to calculate a second mode brightness value according to the first mode measured brightness value and the second ratio. The target brightness ratio calculating circuit is configured to calculate a second mode target brightness ratio according to a target brightness setting value and the second mode brightness value. The target brightness calculating circuit is configured to calculate a second mode red-component target brightness value according to the second mode red-component reference brightness value and the second mode target brightness ratio, calculate a second mode green-component target brightness value according to the second mode green-component reference brightness value and the second mode target brightness ratio, and calculate a second mode blue-component target brightness value according to the second mode blue-component reference brightness value and the second mode target brightness ratio. The colored-component brightness calculating circuit is configured to calculate K second mode red-component brightness values according to the K red-component maximum brightness values of the K sets of maximum brightness values, calculate K second mode green-component brightness values according to the K green-component maximum brightness values of the K sets of maximum brightness values, and calculate K second mode blue-component brightness values according to the K blue-component maximum brightness values of the K sets of maximum brightness values. The interpolating circuit is configured to generate a second mode red-brightness characteristic curve according to the K second mode red-component brightness values, generate a second mode green-brightness characteristic curve according to the K second mode green-component brightness values, and generate a second mode blue-brightness characteristic curve according to the K second mode blue-component brightness values. The gain calculating circuit is configured to calculate a second mode red-brightness gain according to the second mode red-component target brightness value and the second mode red-brightness characteristic curve, calculate a second mode green-brightness gain according to the second mode green-component target brightness value and the second mode green-brightness characteristic curve, and calculate a second mode blue-brightness gain according to the second mode blue-component target brightness value and the second mode blue-brightness characteristic curve, wherein the K second mode red-brightness gain, the K second mode green-brightness gain, and the K second mode blue-brightness gain are used as the second mode calibration data for calibrating the brightness of the display region in the second mode, and the K is an integer greater than one.

An embodiment of the method of the present disclosure can generate second mode calibration data of a second mode according to known first mode calibration data of a first mode. This embodiment includes the following steps: providing the first mode calibration data and reference data, in which the first mode calibration data include a first mode measured brightness value and K set(s) of maximum brightness values of a display region, the display region is one of multiple display regions of a display panel, the reference data include a second ratio of a second mode measured brightness value to the first mode measured brightness value and a set of second mode reference brightness values, and the K is a positive integer; calculating a second mode brightness value according to the first mode measured brightness value and the second ratio; calculating a second mode target brightness ratio according to a target brightness setting value and the second mode brightness value; calculating a set of second mode target brightness values according to the set of second mode reference brightness values and the second mode target brightness ratio; calculating K set(s) of second mode colored-component brightness values according to the K set(s) of maximum brightness values; generating X second mode brightness characteristic curve(s) according to the K set(s) of second mode colored-component brightness values, in which the X is a positive integer; and calculating X second mode brightness gain(s) according to the set of second mode target brightness values and the X second mode brightness characteristic curve(s), in which the X second mode brightness gain(s) are used as the second mode calibration data for calibrating the brightness of the display region in the second mode.

These and other objectives of the present invention will no doubt become obvious to those of ordinary skill in the art after reading the following detailed description of the preferred embodiments that are illustrated in the various figures and drawings.

DETAILED DESCRIPTION OF THE PREFERRED EMBODIMENTS

The present disclosure discloses a calibration device and calibration method for display panel brightness uniformity. The calibration device and calibration method can deduce unknown calibration data from known calibration data; more specifically, the calibration device and calibration method can generate calibration data of other display modes according to known first mode calibration data of a first mode quickly. Accordingly, the whole calibration process can be accelerated, and the production yield can be raised.

Figure 1:
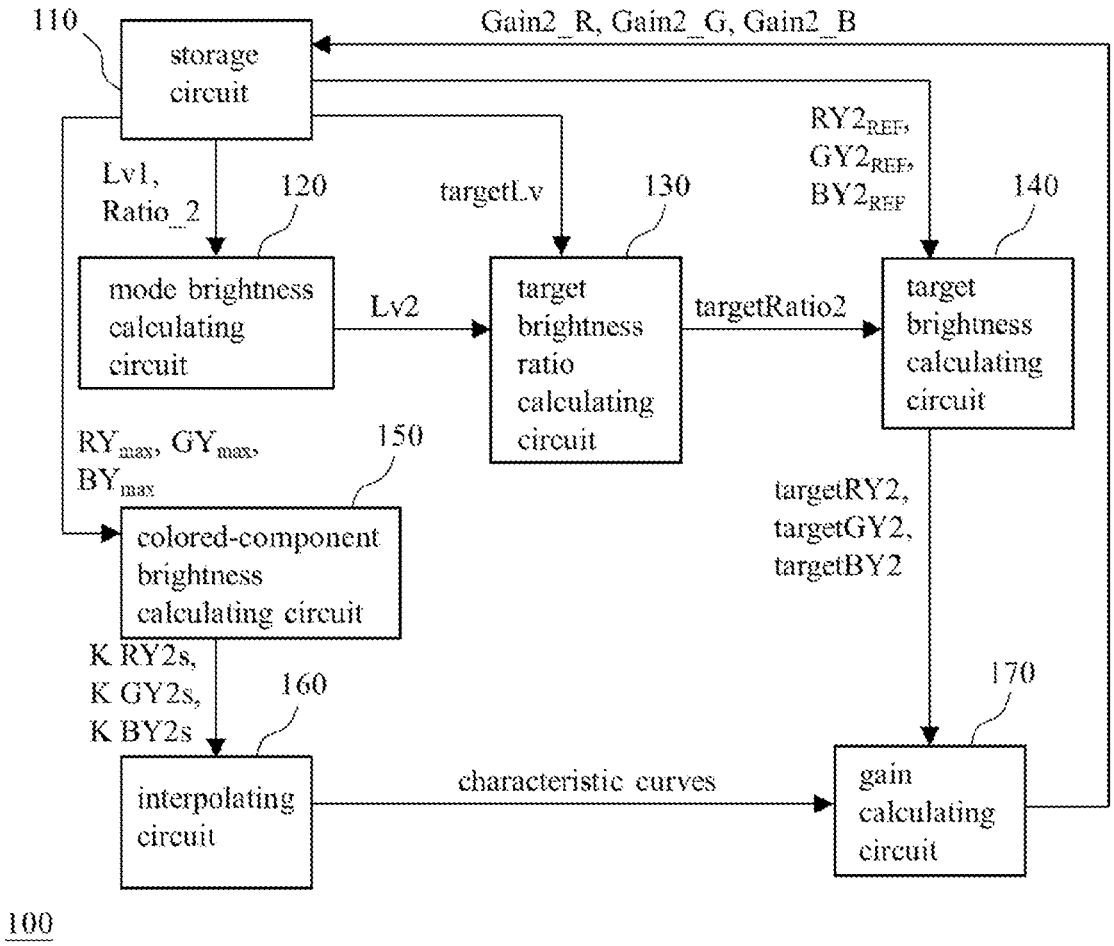
FIG. 1 shows the calibration device for display panel brightness uniformity according to an embodiment of the present disclosure.

FIG. 1 shows an embodiment of the calibration device of the present disclosure. The calibration device 100 of FIG. 1 is configured to calibrate different display regions of a display panel for brightness uniformity, and includes a storage circuit 110, a mode brightness calculating circuit 120, a target brightness ratio calculating circuit 130, a target brightness calculating circuit 140, a colored-component brightness calculating circuit 150, an interpolating circuit 160, and a gain calculating circuit 170. Some or all of the circuits 120-170 in FIG. 1 can be integrated into a single circuit in accordance with the demand for implementation. In addition, each circuit in FIG. 1 alone can be realized with known or self-developed techniques.

Please refer to FIG. 1. The storage circuit 110 is configured to store the first mode calibration data and reference data. The first mode calibration data include K sets of maximum brightness values of a display region and a first mode measured brightness value (Lv1) (e.g., the brightness value of a central display region of the display panel measured by a known two-dimensional color measuring apparatus in a first mode (e.g., gamma mode) in a circumstance that the input values for the display panel are input values of the set having the maximum values (e.g., (R, G, B)=(255, 255, 255)) among the K sets of RGB input values mentioned below), wherein K is an integer greater than one. The display region is one of S display regions of the display panel, and thus the first mode calibration data may further include K sets of maximum brightness values of each of the other (S-1) display region(s) so that the calibration device 100 can generate the calibration data for the (S-1) display region(s) in a similar manner, wherein S is an integer greater than one. The K sets of maximum brightness values are based on K sets of red, green, and blue (RGB) input values; for example, the K is not smaller than six, and any two sets of the K sets of RGB input values (e.g., (R, G, B)=(255, 255, 255); (236, 236, 236); . . . ; (128, 128, 128)) are different. Each set of the K sets of maximum brightness values includes a red-component maximum brightness value ($RY_{max}$), a green-component maximum brightness value ($GY_{max}$), and a blue-component maximum brightness value ($BY_{max}$), and therefore the K sets of maximum brightness values include K red-component maximum brightness values, K green-component maximum brightness values, and K blue-component maximum brightness values.

Please refer to FIG. 1. The reference data stored in the storage circuit 110 include a second ratio (Ratio_2) of a second mode measured brightness value (e.g., the maximum brightness value of the center of the display panel measured by a known color calibration apparatus in a second mode (e.g, specific color temperature mode/print color management (PCM) mode)) to the first mode measured brightness value $$\left(\text{i.e, Ratio_2} = \frac{\text{second mode measured brightness value}}{\text{first mode measured brightness value}}\right).$$

The reference data further include a set of second mode reference brightness values (e.g., a set of second mode maximum brightness values ($RY2_{255(center)}$, $GY2_{255(center)}$, $BY2_{255(center)}$) of the central display region of the display panel in the second mode, in which the central display region is one of the aforementioned S display regions), and the set of second mode reference brightness values is based on a set of second mode predetermined RGB input values (e.g., (R, G, B)=(255, 255, 255)) including a second mode red-component reference brightness value ($RY2_{REF}$), a second mode green-component reference brightness value ($GY2_{REF}$), and a second mode blue-component reference brightness value ($BY2_{REF}$). It should be noted that the way to obtain the first mode calibration data and the reference data can be a known technique as mentioned in the description of related art of this specification or a self-developed technique, and such known or self-developed technique falls beyond the scope of the present invention.

Please refer to FIG. 1. The mode brightness calculating circuit 120 is configured to calculate a second mode brightness value (Lv2) according to the first mode measured brightness value (Lv1) and the second ratio (Ratio_2). For example, the second mode brightness value is obtained with an equation "Lv2=(Lv1/Ratio_1)×Ratio_2", and this equation can be modified according to the demand for implementation. The above-mentioned "Ratio_1" is a first ratio of the first mode measured brightness value to a reference mode measured brightness value (e.g., the maximum measured brightness value)

$$\left(\text{i.e., Ratio_1} = \frac{\text{first mode measured brightness value}}{\text{reference mode measured brightness value}}\right),$$

and the first ratio can be included in the first mode calibration data according to the demand for implementation optionally. In the embodiment of FIG. 1, if the first mode measured brightness value is equal to the reference mode measured brightness value, the first ratio will be one (i.e., Ratio_1=1) and the aforementioned equation is simplified as follows: Lv2=Lv1×Ratio_2. In addition, if the maximum measured brightness value is used as the reference mode measured brightness value, the second ratio is smaller than one (i.e., Ratio_2<1).

Please refer to FIG. 1. The target brightness ratio calculating circuit 130 is configured to calculate a second mode target brightness ratio (targetRatio2) according to a target brightness setting value (targetLv) and the second mode brightness value (Lv2). The target brightness setting value can be included in the aforementioned reference data or provided by a user input or any of other sources. For example, the second mode target brightness ratio can be obtained with an equation "targetRatio2=targetLv/Lv2" which can be modified according to the demand for implementation.

Please refer to FIG. 1. The target brightness calculating circuit 140 is configured to calculate a second mode red-component target brightness value "targetRY2" according to the second mode red-component reference brightness value and the second mode target brightness ratio (e.g., targetRY2=$RY2_{REF}$×targetRatio2), calculate a second mode green-component target brightness value "targetGY2" according to the second mode green-component reference brightness value and the second mode target brightness ratio (e.g., targetGY2=$GY2_{REF}$×targetRatio2), and calculate a second mode blue-component target brightness value "targetBY2" according to the second mode blue-component reference brightness value and the second mode target brightness ratio (e.g., targetRY2=$RY2_{REF}$×targetRatio2).

Please refer to FIG. 1. The colored-component brightness calculating circuit 150 is configured to calculate K second mode red-component brightness values (i.e., K RY2s that are based on the aforementioned K sets of RGB input values), calculate K second mode green-component brightness values (i.e., K GY2s that are based on the K sets of RGB input values), and calculate K second mode blue-component brightness values (i.e., K BY2s that are based on the K sets of RGB input values). For example, the RY2, GY2, and BY2 based on each set of RGB input values (e.g., ($R_{INPUT}$, $G_{INPUT}$, $B_{INPUT}$)=(255, 255, 255), (236, 236, 236), . . . , or (128, 128, 128)) are obtained with the following equations:

$$RY2 = RY_{max} \times \left(\frac{R_{INPUT}}{255}\right)^{gamma2};\ GY2 = GY_{max} \times \left(\frac{G_{INPUT}}{255}\right)^{gamma2};$$

$$\text{and } BY2 = BY_{max} \times \left(\frac{B_{INPUT}}{255}\right)^{gamma2},$$

in which "gamma2" is the gamma value of the second mode dependent on the given characteristic of the second mode, and this gamma value can be determined in advance, stored in the storage circuit 110, and set according to the demand for implementation optionally. Each of the above equations can be modified in accordance with the demand for implementation.

Please refer to FIG. 1. The interpolating circuit 160 is configured to perform interpolation and/or extrapolation according to the K second mode red-component brightness values (i.e., K RY2s that are based on the K sets of RGB input values) and thereby generate a second mode red brightness characteristic curve, perform interpolation and/or extrapolation according to the K second mode green-component brightness values (i.e., K GY2s that are based on the K sets of RGB input values) and thereby generate a second mode green brightness characteristic curve, and perform interpolation and/or extrapolation according to the K second mode blue-component brightness values (i.e., K BY2s that are based on the K sets of RGB input values) and thereby generate a second mode blue brightness characteristic curve. Accordingly, the interpolating circuit 160 generates three characteristic curves for each display region, and each curve can be used to find out an output value in accordance with an input value. More specifically, each characteristic curve is indicative of the relationship between the input values and the output values in regard to the characteristic curve itself; the range of the input values (e.g., 128-255 including K original red/green/blue input values) concerning each characteristic curve can be determined according to the demand for implementation, and the output values concerning each characteristic curve includes K RY2s/K GY2s/K BY2s generated by the colored-component brightness calculating circuit 150.

Figure 2A:
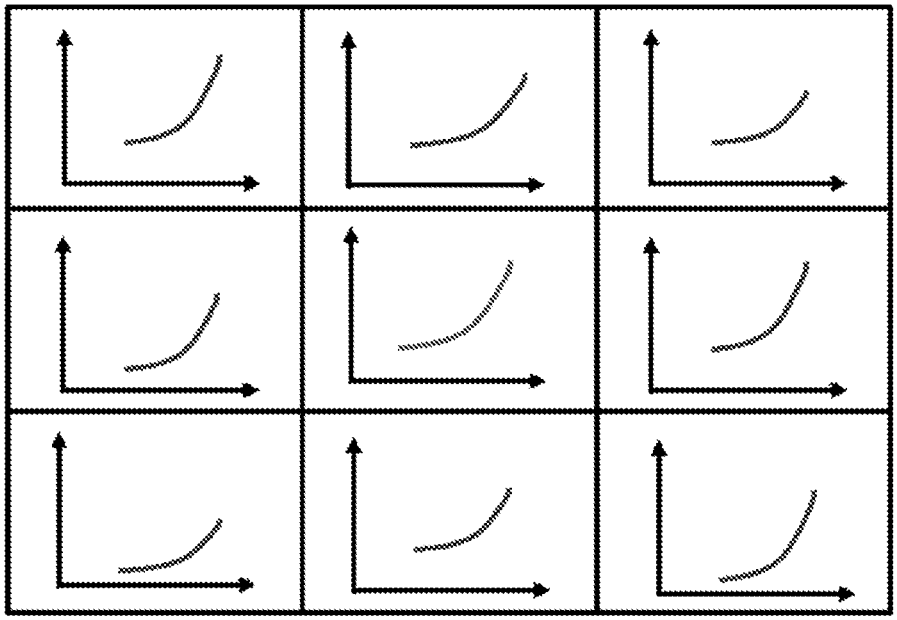
FIG. 2*a* shows brightness characteristic curves of different display regions of the same display panel.
Figure 2B:
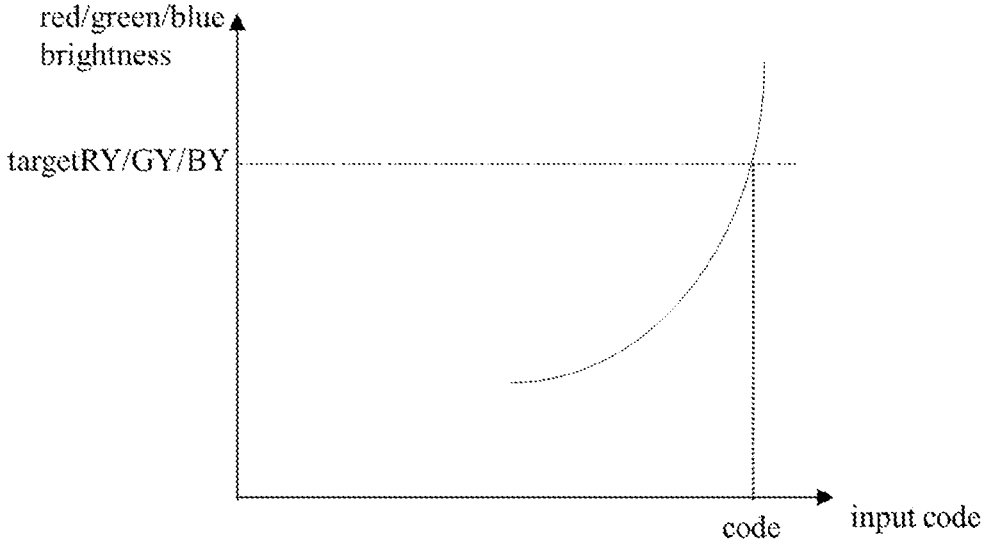
FIG. 2*b* shows a red-component/green-component/blue-component brightness characteristic curve of a display region.

Please refer to FIG. 1. The gain calculating circuit 170 is configured to calculate a second mode red brightness gain (Gain2_R) according to the second mode red-component target brightness value (i.e., the aforementioned targetRY2) and the second mode red brightness characteristic curve, calculate a second mode green brightness gain (Gain2_G) according to the second mode green-component target brightness value (i.e., the aforementioned targetGY2) and the second mode green brightness characteristic curve, and calculate a second mode blue brightness gain (Gain2_B) according to the second mode blue-component target brightness value (i.e., the aforementioned targetBY2) and the second mode blue brightness characteristic curve. The second mode red, green, and blue brightness gains are stored in the storage circuit 110 and used as the second mode calibration data for calibrating the aforementioned display region in the second mode for brightness uniformity. For example, FIG. 2*a* shows the brightness characteristic curves (horizontal axis: input code; vertical axis: output brightness) of multiple display regions 200 of the aforementioned display panel. FIG. 2*b* shows an exemplary red-component/green-component/blue-component brightness characteristic curve (horizontal axis: input code; vertical axis: red/green/blue brightness) of any of the multiple display regions 200. People of ordinary skill in the art can refer to FIGS. 2*a*-2*b* and the preceding disclosure to appreciate that in regard to each set of RGB input values the Gain2_R is equal to "the input code of the second mode red brightness characteristic curve corresponding to targetRY2" divided by "the maximum red input brightness value 255"

$$\left(\text{i.e., Gain2_}R = \frac{\text{input code_}targetRY2}{255}\right),$$

the Gain2_G is equal to "the input code of the second mode green brightness characteristic curve corresponding to targetGY2" divided by "the maximum green input brightness value 255"

$$\left(\text{i.e., Gain2_}G = \frac{\text{input code_}targetGY2}{255}\right),$$

and the Gain2_B is equal to "the input code of the second mode blue brightness characteristic curve corresponding to targetBY2" divided by "the maximum blue input brightness value 255"

$$\left(\text{i.e., Gain2_}B = \frac{\text{input code_}targetBY2}{255}\right),$$

Accordingly, provided the Gain2_R/Gain2_G/Gain2_B of a display region of the display panel is $$\frac{\text{code1}}{255}$$

and the Gain2_R/Gain2_G/Gain2_B of another display region of the display panel is $$\frac{\text{code2}}{255},$$

when both the input signals for the two different display regions are indicative of the maximum red/green/blue input brightness values (i.e., 255), the output brightness values (i.e., input value×Gain) of the two different display regions will be $$\text{“}255 \times \frac{\text{code1}}{255} = targetRY2/targetGY2/targetBY2\text{” and}$$

$$\text{“}255 \times \frac{\text{code2}}{255} = targetRY2/targetGY2/targetBY2\text{”}$$

respectively, and therefore the output brightness values (i.e., targetRY2s/targetGY2s/targetBY2s) of the two different display regions are the same and the brightness uniformity of the two different display regions is realized.

Figure 3:
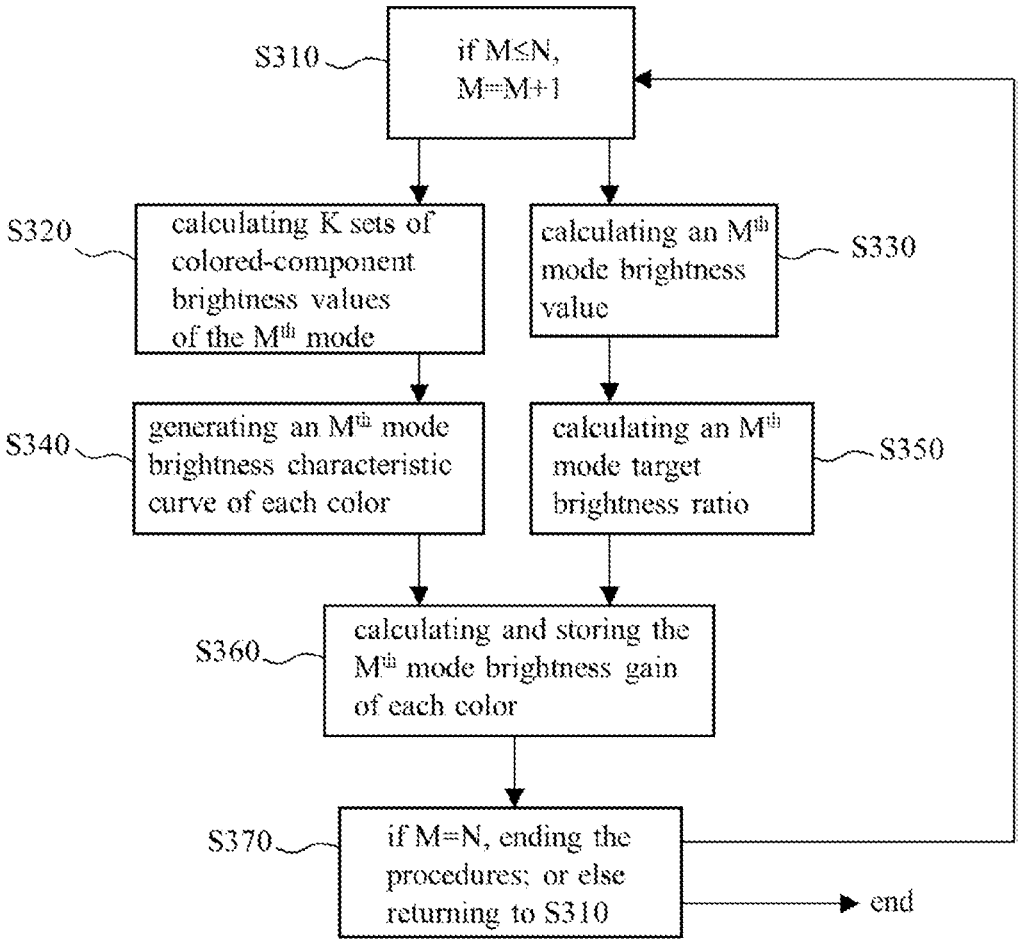
FIG. 3 shows an embodiment of the procedures executed by the calibration device of FIG. 1.

FIG. 3 shows an embodiment of the procedures executed by the calibration device 100 of FIG. 1 for the brightness calibration of every display region of the aforementioned display panel. The procedures of FIG. 3 include:

S310: if a current mode is the $M^{th}$ mode and M≤N, making M=M+1, wherein both the M and the N are positive integers, and the N is a total number of display panel modes under consideration.

S320: calculating K sets of colored-component brightness values of the $M^{th}$ mode (e.g., K red-component brightness values of the $M^{th}$ mode ($RY_M$), K green-component brightness values of the $M^{th}$ mode ($GY_M$), and K blue-component brightness values of the $M^{th}$ mode ($BY_M$)) according to pre-stored K sets of maximum brightness values that are based on K sets of input values respectively.

S330: calculating an $M^{th}$ mode brightness value ($Lv_M$) according to a pre-stored first mode measured brightness value (Lv1) and an $M^{th}$ ratio (Ratio_M).

S340: generating an $M^{th}$ mode brightness characteristic curve of each color according to the K sets of colored-component brightness values of the $M^{th}$ mode.

S350: calculating an $M^{th}$ mode target brightness ratio ($targetRatio_M$) according to a pre-stored target brightness setting value (targetLv) and the $M^{th}$ mode brightness value; and calculating a set of target brightness values of the $M^{th}$ mode (e.g., the $M^{th}$ mode red-component target brightness value ($targetRY_M$), the $M^{th}$ mode green-component target brightness value ($targetGY_M$), and the $M^{th}$ mode blue-component target brightness value ($targetBY_M$)) according to a set of reference brightness values of the $M^{th}$ mode and the $M^{th}$ mode target brightness ratio.

S360: calculating the $M^{th}$ mode brightness gain of each color according to the set of target brightness values of the $M^{th}$ mode and the $M^{th}$ mode brightness characteristic curve; and storing the $M^{th}$ mode brightness gain of each color.

S370: if the current mode is the $M^{th}$ mode and M=N, ending the procedures; or else returning to S310.

Since those of ordinary skill in the art can refer to the disclosure of the embodiment of FIG. 1 to understand the procedures of FIG. 3, repeated and redundant description is omitted.

Figure 4:
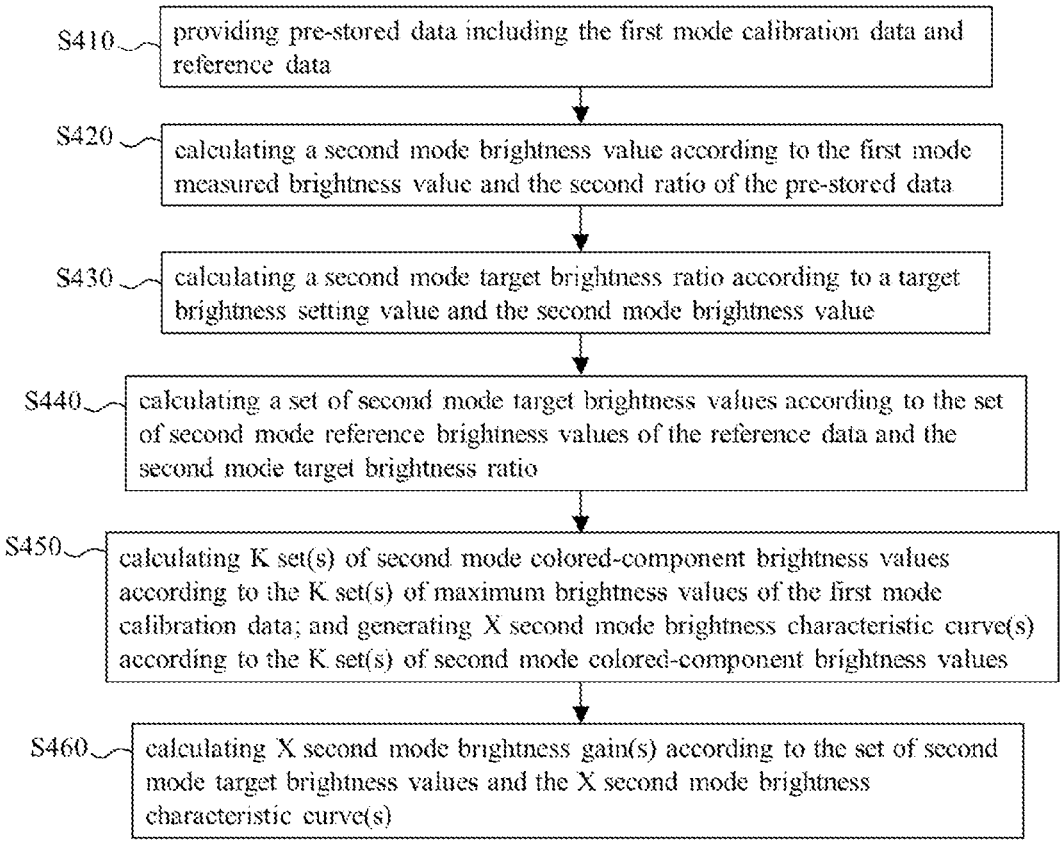
FIG. 4 shows the calibration method for display panel brightness uniformity according to an embodiment of the present disclosure.

FIG. 4 shows an embodiment of the calibration method of the present disclosure for display panel brightness uniformity. This embodiment can generate second mode calibration data according to known first mode calibration data, and includes the following steps:

S410: providing the first mode calibration data stored in advance and providing reference data, in which the first mode calibration data include a first mode measured brightness value and K set(s) of maximum brightness values of a display region, the display region is one of multiple display regions of a display panel, the reference data include a second ratio of a second mode measured brightness value to the first mode measured brightness value and a set of second mode reference brightness values, and the K is a positive integer. This step can be carried out by the storage circuit 110 of FIG. 1 or the equivalent thereof.

S420: calculating a second mode brightness value according to the first mode measured brightness value and the second ratio. This step can be carried out by the calculating circuit 120 of FIG. 1 or the equivalent thereof.

S430: calculating a second mode target brightness ratio according to a target brightness setting value and the second mode brightness value. This step can be carried out by the calculating circuit 130 of FIG. 1 or the equivalent thereof.

S440: calculating a set of second mode target brightness values, that is to say X second mode brightness value(s) being representative of X color(s) respectively, according to the set of second mode reference brightness values and the second mode target brightness ratio. This step can be carried out by the calculating circuit 140 of FIG. 1 or the equivalent thereof.

S450: calculating K set(s) of second mode colored-component brightness values according to the K set(s) of maximum brightness values; and then generating X second mode brightness characteristic curve(s) according to the K set(s) of second mode colored-component brightness values, in which the X is a positive integer. This step can be carried out by the calculating circuit 150 and the interpolating circuit 160 of FIG. 1 or the equivalent thereof.

S460: calculating X second mode brightness gain(s) according to the set of second mode target brightness values and the X second mode brightness characteristic curve(s), in which the X second mode brightness gain(s) are used as the second mode calibration data for calibrating the brightness of the display region in the second mode. This step can be carried out by the calculating circuit 170 of FIG. 1 or the equivalent thereof.

Since those of ordinary skill in the art can refer to the disclosure of the device embodiment to appreciate the detail and modification of the method embodiment of FIG. 4, which implies that the features, alone or in combination, of the device embodiment can be applied to the method embodiment in a reasonable way, repeated and redundant description is omitted.

It should be noted that people of ordinary skill in the art can selectively use some or all of the features of any embodiment in this specification or selectively use some or all of the features of multiple embodiments in this specification to implement the present invention as long as such implementation is practicable, which implies that the way to carry out the present invention can be flexible.

To sum up, the calibration device and calibration method of the present disclosure can quickly generate second mode calibration data according to known first mode calibration data, and thereby accelerate the whole process of calibration and improve the production efficiency.

The aforementioned descriptions represent merely the preferred embodiments of the present invention, without any intention to limit the scope of the present invention thereto. Various equivalent changes, alterations, or modifications based on the claims of present invention are all consequently viewed as being embraced by the scope of the present invention.

What is claimed is:

1. A calibration device for display panel brightness uniformity, the calibration device being capable of generating second mode calibration data of a second mode according to first mode calibration data of a first mode and comprising:

a storage circuit configured to store the first mode calibration data and reference data, in which the first mode calibration data include a first mode measured brightness value and K sets of maximum brightness values of a display region, the display region is one of multiple display regions of a display panel, the K sets of maximum brightness values are based on K sets of red, green, and blue (RGB) input values, each set of the K sets of maximum brightness values includes a red-component maximum brightness value, a green-component maximum brightness value, and a blue-component maximum brightness value, the reference data include a second ratio of a second mode measured brightness value to the first mode measured brightness value and a set of second mode reference brightness values, and the set of second mode reference brightness values includes a second mode red-component reference brightness value, a second mode green-component reference brightness value, and a second mode blue-component reference brightness value;

a mode brightness calculating circuit configured to calculate a second mode brightness value according to the first mode measured brightness value and the second ratio;

a target brightness ratio calculating circuit configured to calculate a second mode target brightness ratio according to a target brightness setting value and the second mode brightness value;

a target brightness calculating circuit configured to calculate a second mode red-component target brightness value according to the second mode red-component reference brightness value and the second mode target brightness ratio, calculate a second mode green-component target brightness value according to the second mode green-component reference brightness value and the second mode target brightness ratio, and calculate a second mode blue-component target brightness value according to the second mode blue-component reference brightness value and the second mode target brightness ratio;

a colored-component brightness calculating circuit configured to calculate K second mode red-component brightness values according to the K red-component maximum brightness values of the K sets of maximum brightness values, calculate K second mode green-component brightness values according to the K green-component maximum brightness values of the K sets of maximum brightness values, and calculate K second mode blue-component brightness values according to the K blue-component maximum brightness values of the K sets of maximum brightness values;

an interpolating circuit configured to generate a second mode red-brightness characteristic curve according to the K second mode red-component brightness values, generate a second mode green-brightness characteristic curve according to the K second mode green-component brightness values, and generate a second mode blue-brightness characteristic curve according to the K second mode blue-component brightness values; and a gain calculating circuit configured to calculate a second mode red-brightness gain according to the second mode red-component target brightness value and the second mode red-brightness characteristic curve, calculate a second mode green-brightness gain according to the second mode green-component target brightness value and the second mode green-brightness characteristic curve, and calculate a second mode blue-brightness gain according to the second mode blue-component target brightness value and the second mode blue-brightness characteristic curve, wherein the K second mode red-brightness gain, the K second mode green-brightness gain, and the K second mode blue-brightness gain are used as the second mode calibration data for calibrating brightness of the display region in the second mode, the K is an integer greater than one, the K is not smaller than six, and any two sets of the K sets of RGB input values are different.

2. The calibration device of claim 1, wherein the reference data include a first ratio of the first mode measured brightness value to a reference mode measured brightness value, and the mode brightness calculating circuit is configured to calculate the second mode brightness value according to the first mode measured brightness value, the first ratio, and the second ratio.

3. The calibration device of claim 1, wherein the first mode measured brightness value is equal to the reference mode measured brightness value.

4. The calibration device of claim 1, wherein each set of the K sets of RGB input values has a red input value, a green input value, and a blue input value; and the red input value, the green input value, and the blue input value in a same set of the K sets of RGB input values are the same.

5. The calibration device of claim 4, wherein the K is not smaller than six, and each value of the red input value, the green input value, and the blue input value is between 128 and 255.

6. The calibration device of claim 1, wherein both the first mode measured brightness value and the second mode measured brightness value are brightness values of a center of the display panel.

7. The calibration device of claim 6, wherein both the first mode measured brightness value and the second mode measured brightness value are the brightness values of the center of the display panel based on a set of maximum RGB input values, and the set of maximum RGB input values is one of the K sets of RGB input values.

8. The calibration device of claim 1, wherein the set of second mode reference brightness values is a set of second mode maximum brightness values of a central display region of the display panel in the second mode.

9. A calibration method for display panel brightness uniformity, the calibration method being capable of generating second mode calibration data of a second mode according to first mode calibration data of a first mode and comprising following steps:

providing the first mode calibration data and reference data, in which the first mode calibration data include a first mode measured brightness value and K set(s) of maximum brightness values of a display region, the display region is one of multiple display regions of a display panel, the reference data include a second ratio of a second mode measured brightness value to the first mode measured brightness value and a set of second mode reference brightness values, and the K is a positive integer;

calculating a second mode brightness value according to the first mode measured brightness value and the second ratio;

calculating a second mode target brightness ratio according to a target brightness setting value and the second mode brightness value;

calculating a set of second mode target brightness values according to the set of second mode reference brightness values and the second mode target brightness ratio;

calculating K set(s) of second mode colored-component brightness values according to the K set(s) of maximum brightness values;

generating X second mode brightness characteristic curve(s) according to the K set(s) of second mode colored-component brightness values, in which the X is a positive integer; and calculating X second mode brightness gain(s) according to the set of second mode target brightness values and the X second mode brightness characteristic curve(s), in which the X second mode brightness gain(s) are used as the second mode calibration data for calibrating brightness of the display region in the second mode, wherein the reference data include a first ratio of the first mode measured brightness value to a reference mode measured brightness value, and the step of calculating the second mode brightness value includes: calculating the second mode brightness value according to the first mode measured brightness value, the first ratio, and the second ratio.

10. The calibration device of claim 9, wherein the first mode measured brightness value is equal to the reference mode measured brightness value.

11. The calibration method of claim 9, wherein the K is greater than one, the K sets of maximum brightness values are based on K sets of red, green, and blue (RGB) input values, and any two sets of the K sets of RGB input values are different.

12. The calibration method of claim 11, wherein each set of the K sets of RGB input values has a red input value, a green input value, and a blue input value, and the red input value, the green input value, and the blue input value in a same set of the K sets of RGB input values are the same.

13. The calibration method of claim 12, wherein the K is not smaller than six, and each value of the red input value, the green input value, and the blue input value is between 128 and 255.

14. The calibration method of claim 9, wherein both the first mode measured brightness value and the second mode measured brightness value are brightness values of a center of the display panel.

15. The calibration method of claim 14, wherein both the first mode measured brightness value and the second mode measured brightness value are the brightness values of the center of the display panel based on a set of maximum RGB input values, and the set of maximum RGB input values is one of the K sets of RGB input values.

16. The calibration method of claim 9, wherein the set of second mode reference brightness values is a set of second mode maximum brightness values of a central display region of the display panel in the second mode.

* * * * *